US006727879B2

(12) United States Patent
Sako

(10) Patent No.: US 6,727,879 B2
(45) Date of Patent: Apr. 27, 2004

(54) LCD DRIVER IN MULTI-LINE SELECTION DRIVING METHOD

(75) Inventor: Norimitsu Sako, Mihama-ku (JP)

(73) Assignee: JFE Steel Corporation, Tokyo (JP)

( * ) Notice: Subject to any disclaimer, the term of this patent is extended or adjusted under 35 U.S.C. 154(b) by 198 days.

(21) Appl. No.: 09/933,200

(22) Filed: Aug. 21, 2001

(65) Prior Publication Data

US 2002/0024487 A1 Feb. 28, 2002

(30) Foreign Application Priority Data

Aug. 28, 2000 (JP) ..... 2000-257381

(51) Int. Cl.[7] ..... G09G 3/36
(52) U.S. Cl. ..... 345/98; 345/204
(58) Field of Search ..... 345/87–103, 204, 345/690, 589, 591, 593, 549, 550

(56) References Cited

U.S. PATENT DOCUMENTS 4,822,142 A * 4/1989 Yasui ..... 349/48
5,043,917 A * 8/1991 Okamoto ..... 345/550
5,900,857 A * 5/1999 Kuwata et al. ..... 345/100
5,929,832 A * 7/1999 Furukawa et al. ..... 345/98
6,025,822 A * 2/2000 Motegi et al. ..... 345/98
6,333,729 B1 * 12/2001 Ha ..... 345/98

* cited by examiner

*Primary Examiner*—Regina Liang
(74) *Attorney, Agent, or Firm*—Oliff & Berridge, PLC

(57) ABSTRACT

An LCD driver is provided wherein the chip size and the power consumption of the LCD driver used in the MLS method is reduced. Color data for two or more simultaneously driven rows of an LCD is stored in one word of a display memory. Color data is separated into individual color components and color data for simultaneously driven rows of the LCD is stored such that bits of the same color component are arranged adjacent to each other for each color column of the LCD. Additionally, color data for simultaneously driven rows of the LCD is stored in a plurality of words of the display memory. Color data for simultaneously driven rows of the LCD is output by selecting simultaneously the plurality of words of the display memory storing them.

12 Claims, 6 Drawing Sheets

FIG. 6
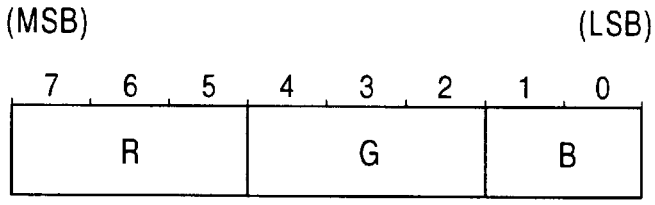
FIG. 7
PRIOR ART
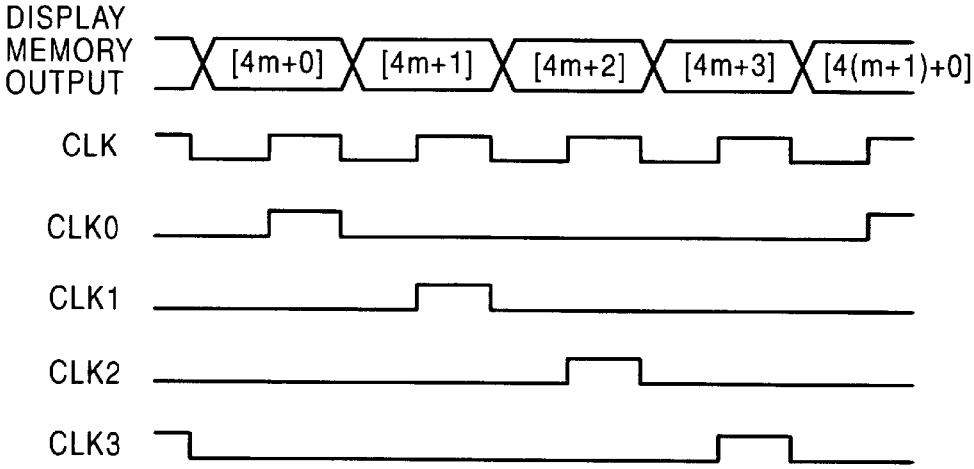
FIG. 8
$$M = \begin{pmatrix} 0 & 1 & 1 & 1 \\ 1 & 1 & 0 & 1 \\ 1 & 0 & 1 & 1 \\ 1 & 1 & 1 & 0 \end{pmatrix}$$

LCD DRIVER IN MULTI-LINE SELECTION DRIVING METHOD

BACKGROUND OF THE INVENTION

1. Field of Invention

The present invention relates to an LCD driver used in a multi-line selection driving method (called "MLS method" thereafter) for simultaneously driving a plurality of rows of a super twisted nematic liquid crystal display (STN-LCD). The LCD comprises a plurality of pixels that are arranged in a matrix, where one pixel of color data includes a plurality of bits.

2. Description of Related Art

An LCD driver in the MLS method simultaneously drives a plurality of rows (common) of the STN-LCD at a predetermined potential. The LCD driver in the MLS method drives each column (segment) at a plurality of potentials. For example, a potential is selected from among one plus the number of simultaneously driven rows in accordance with color data in order to achieve a rapid response display.

An outline of the structure of an LCD driver in the conventional MLS method and problems thereof will be described below with reference to FIGS. 5 to 7.

FIG. 5 is an outline view of an example of the LCD driver in the conventional MLS method.

An LCD driver 30 includes a line counter 32, a line decoder 34, and a display memory 36. The LCD driver 30 drives four rows of an LCD simultaneously. Further, the LCD driver 30 includes line registers 37, a scrambler 38, EXOR gates 40, an adder 42, a potential selection register 43, and a potential selector 44 for each column corresponding to each RGB (Red, Green, Blue) color.

In the exemplified LCD driver 30, clock signals are counted by the line counter 32, and the counter value of the line counter 32 is decoded by the line decoder 34. One word signal W[4m+n] corresponding to the counter value is sequentially activated for every count. When the word signal is activated, color data stored in one word in the display memory 36 corresponding to the activated word signal is output.

In the display memory 36 shown in FIG. 5, one horizontal row represents color data for one word. Each set of color data for the word in the display memory 36 corresponds to a color (gray scale) of each column for one row of the LCD. Color data for one pixel is represented by gray scale data of three colors stored in the display memory 36 as a unit of RGB. For example, R(4m+0,0), G(4m+0,0), and B(4m+0,0) at the upper left in the display memory represents RGB color data for one pixel at the 0th row and 0th column among four rows simultaneously driven of the LCD.

Further, for example, R(4m+0,0), R(4m+1,0), R(4m+2,0) and R(4m+3,0) represents each R data at the 0th column for the four simultaneously driven rows of the LCD. Furthermore, R(4m+0, 1), R(4m+1,1), R(4m+2, 1) and R(4m+3, 1) represent each R data at the first column of the four simultaneously driven rows of the LCD. It should be noted that this method also applies to the G and B data.

The color data for one pixel includes 8 bits of display memory in the case of 256 color (gray scale) display as shown, for example, in FIG. 6. This example is arranged such that, in one pixel of color data, 3 bits (7 to 5) at the most significant bit (MSB) side are data for R, the following 3 bits (4 to 2) are data for G, and the 2 bits (1 and 0) at the least significant bit (LSB) side are data for B. In this case, each of R and G produces an 8-gray scale display and B produces a 4-gray scale display, resulting in a total of 256 color (gray scales) display. Writing to or reading from the display memory 36 using an external controller (not shown) is performed for color data by a row decoder and a column decoder (not shown).

Color data for four simultaneously driven rows of the LCD are sequentially output from the display memory 36 in synchronization with a clock signal CLK, as shown in a timing chart in FIG. 7. Here, the color data output from the display memory, for example, within the 0th column of data R(0–3, 0), data R(0,0) at the 0th row and 0th column of R, data R(1,0) at the first row and 0th column of R, and data R(2,0) at the second row and 0th column of R, are held in positions 0, 1, and 2 of the line registers 37 at the rising edges of the clock signals CLK 0, 1, and 2, respectively.

In the LCD driver 30, as shown in the example, because color data for the 0th to third rows are output from the display memory 36 sequentially by timesharing, data R(0–2, 0) at the 0th to second rows and 0th column of R are held in the line registers 37 once. Data R(0–2, 0) at the 0th to second and 0th column of R held in the line registers 37 are input to corresponding scramblers 38, respectively. On the other hand, data R(3,0) at the third row and 0th column of R is not held in the line register 37, but is input to the corresponding scrambler 38 directly.

The example shown adopts a frame-rate-control (FRC) method as a modulation method for gray scale display. In this case, the gray scale display is implemented by selecting, in accordance with gray scale data stored in the display memory 36, a ratio of the number of frames to be turned on or off by each pixel within the predetermined number of frames (pattern), and by controlling the ratio by timesharing. Gray scale conversion data of R is time-sequential data prepared for each gray scale corresponding to each gray scale of R and indicating the ratio for being turned on or off for each pixel. For example, gray scale conversion data of R is selected according to the gray scale represented by the data R (0–3, 0) at 0th column of R, and gray scale display of the corresponding pixel is performed based on the data.

In the example shown, in accordance with data R(0–3,0) at the 0th column of R and gray scale conversion data of R, signals corresponding to the gray scales represented by the data R(0–3,0) at the 0th column of R are output from the respective scramblers 38. The signals output from the scramblers 38 undergoes an exclusive-OR operation with corresponding row electrode selection patterns 0 to 3 by the EXOR gate 40, respectively. Then, each operation's result is added by the adder 42, and held in a potential selection register 43 in synchronization with a clock signal CLK3.

The row electrode selection patterns 0 to 3 represent column components that have an orthogonal relation with the row direction to each other in a row selection matrix provided for the LCD driver 30. An example of the row selection matrix is shown in FIG. 8. The column components of the row selection matrix correspond to the four simultaneously driven rows of the LCD. In the LCD driver 30 used in the MLS method, the exclusive-OR operation between color data at each column of each simultaneously driven row of the LCD and corresponding column components in the row selection matrix is executed. Then, a potential corresponding to the arithmetic addition is selected in order to drive each column of the LCD.

The signal output from the adder 42 is input to the potential selection register 43. Then, one potential out of several potentials is selected and output by the potential selector 44. The number of the several potentials is equal to the number of simultaneously driven rows of the LCD plus one. For example, in this case, one potential out of five potentials (V0 to V4) is selected. The 0th column of R in the LCD is driven at the potential output from the potential selector 44. It should be noted that each column of each color in the LCD is driven similarly at the corresponding potential output from potential selector 44.

In the LCD driver used in the conventional MLS method, color data for one row is sequentially output by the row from the display memory 36. Thus, in order to drive four rows simultaneously, color data for at least three out of the four rows driven is required to be held in the line register 37 in advance. Therefore, like a mobile phone, if one pixel of color data includes 8 bits and an STN-LCD has 128 columns of pixel for one row, line registers are required for 128 columns×8 bits×3 rows=3072 bits.

Further, like the example shown, the potential selection register 43 requires 3 bits to select one potential out of five potentials for each column of each color in the case of four simultaneously driven rows in the LCD. Thus, it needs 3 colors×128 columns×3 bits=1152 bits in total. Therefore, when adding 3072 bits in the above-described line register 37 and 1152 bits in the potential selection register 43, registers for a total of 3072+1152=4224 bits are needed.

In general, since a register includes about twenty transistors, the chip-size of the LCD driver 30 increases significantly, which increases the cost. Further, the registers operate based on clock signal CLK four times the speed of the row selection time, which results in a great amount of power consumption. Thus, the battery driving time is decreased in battery-driven electronic equipment such as the above-described mobile phone.

SUMMARY OF THE INVENTION

It is an object of the present invention to provide an LCD driver that is able to solve the problems of the above-described conventional technologies, reduce the chip-size and decrease power consumption.

In order to achieve this object, one aspect of the present invention provides an LCD driver for simultaneously driving a plurality of rows of an LCD at a predetermined potential, comprising a display memory for storing color data. In this case, the LCD driver stores the color data for two or more simultaneously driven rows of the LCD in the display memory, and selects a potential corresponding to the color data stored in the display memory from several potentials in order to drive each column of the LCD.

In this embodiment, the number of the potentials may be equal to the number of rows of the LCD plus one.

Preferably, the LCD driver separates the color data into each color component and stores color data corresponding to simultaneously driven rows of the LCD in the display memory, such that bits having the same color component are adjacent to each other for each column of the LCD.

Further, the LCD driver may store color data corresponding to the simultaneously driven rows of the LCD in several words of the display memory. The LCD driver may simultaneously select several words of the display memory for the simultaneously driven rows of the LCD and output the color data.

According to another aspect of the present invention, there is provided an LCD driver for simultaneously driving a plurality of rows of an LCD at a predetermined potential, comprising a display memory for storing color data. In this case, the LCD driver separates color data into individual color components and stores the color data for simultaneously driven rows of the LCD in the display memory such that bits having the same color component are adjacent to each other for each column of the LCD. According to the same aspect, the LCD driver stores color data for simultaneously driven rows of the LCD in several words of the display memory and simultaneously selects the several words of the display memory storing color data for the simultaneously driven rows of the LCD and outputs the color data. In both aspects, the LCD driver then selects a potential corresponding to the color data stored in the display memory from several potentials in order to drive each column of the LCD.

Here, the number of the potentials may be equal to the number of rows of the LCD plus one.

Preferably, the LCD driver separates the color data into individual color components and stores color data for simultaneously driven rows of the LCD in the display memory such that bits having the same color component are adjacent to each other for each column of the LCD.

BRIEF DESCRIPTION OF THE DRAWINGS

FIG. 6 is a conceptual diagram of an example showing the structure of color data for one pixel; and FIG. 7 is a timing chart showing the operation of the embodiment of the LCD driver shown in FIG. 5.

FIG. 8 is an example of a row selection matrix provided for the LCD driver.

DETAILED DESCRIPTION OF PREFERRED EMBODIMENTS

An LCD driver according to the present invention will be described below in detail based on the preferred embodiment shown in the attached drawings.

Figure 1:
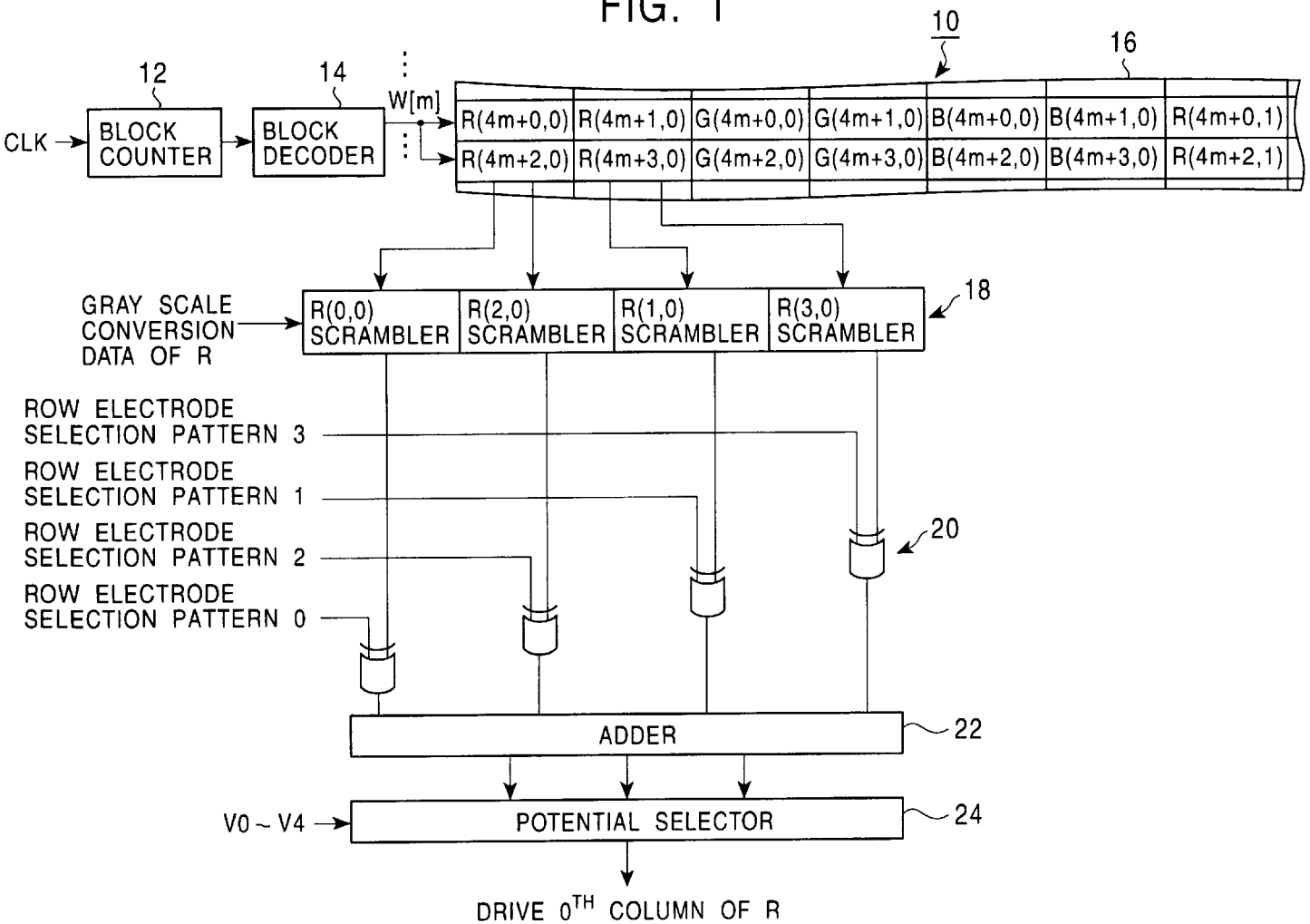
FIG. 1 is a schematic diagram of the structure of embodiment of an LCD driver according to the present invention.

FIG. 1 is a schematic diagram of the structure of one embodiment of an LCD driver according to the present invention.

An LCD driver 10 according to the present invention adopts the MLS method for driving four rows (common) of an LCD simultaneously and includes a block counter 12, a block decoder 14, and a display memory 16. Further, the LCD driver 10 includes scramblers 18, EXOR gates 20, an adder 22, and a potential selector 24 for each column (segment) of each color RGB.

In the LCD driver 10, the clock signal CLK is counted by the block counter 12, and the counter value of the block counter 12 is decoded by the block decoder 14. Word signal W[m] is output from the block decoder 14 and one word signal corresponding to the counter value of the block counter 12 is activated sequentially for every count. Two words of the display memory 16 corresponding to the activated word signal are simultaneously selected.

In the display memory 16 shown in FIG. 1, one horizontal row represents color data for one word. Color data stored in the two words selected by the activated word signal is output from the display memory 16 simultaneously. Here, color data for two rows of the LCD is stored in one word of the display memory 16. That is, color data for four rows of the LCD is output simultaneously from two selected words of the display memory 16.

Figure 5:
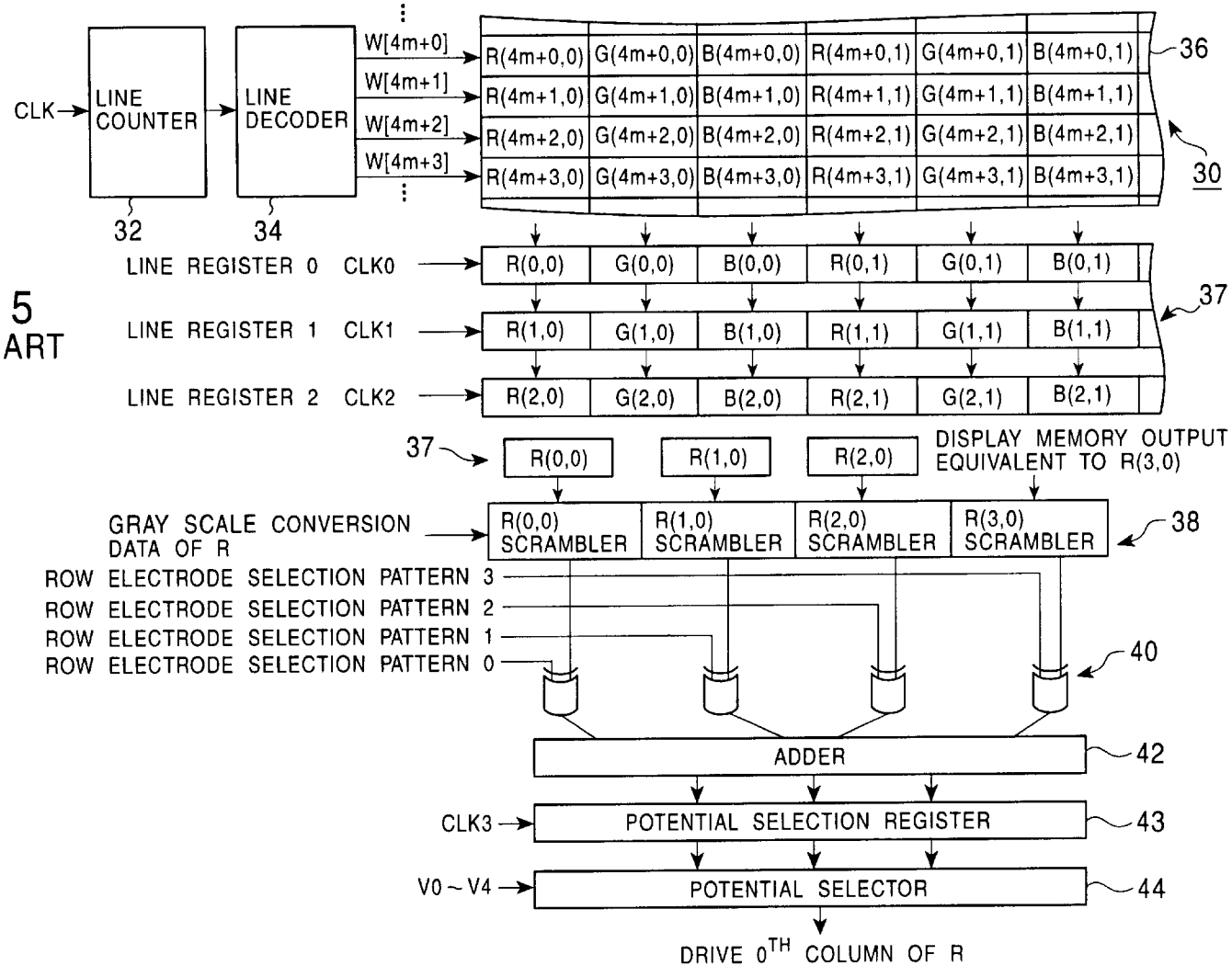
FIG. 5 PRIOR ART
FIG. 5 is a schematic diagram of the structure of one example of a conventional LCD driver.

In other words, the display memory 16 of the LCD driver 10 according to the present invention shown in FIG. 1 has a bit width four times of that of the display memory 36 of the conventional LCD driver 30 shown in FIG. 5. That is, in the case of this embodiment, color data for two rows of the LCD are stored in one word of the display memory 16. A total of four rows of color data is output by selecting two words of the display memory 16 simultaneously through one word signal.

In the display memory 16, C(4m+i,j) represents C color data at the ith row by the jth column among four simultaneously driven rows. For example, R(4m+0,0), G(4m+0,0), and B(4m+0,0) represent color data of RGB at the 0th row and 0th column among four rows driven at the same time, respectively. R(4m+0,0), R(4m+1,0), R(4m+2,0), R(4m+3, 0) represent data of R at the 0th column of the four rows driven at the same time.

Figure 2:
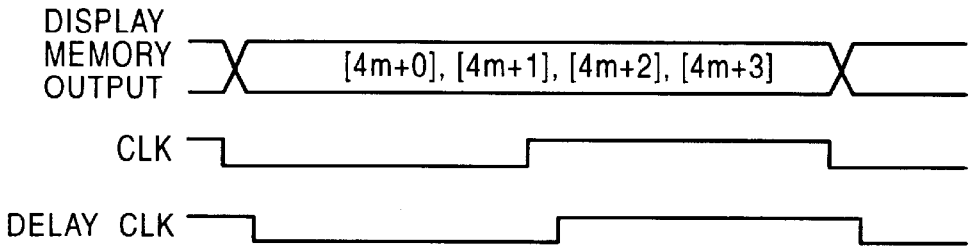
FIG. 2 is a timing chart representing the operation of the embodiment of the LCD driver shown in FIG. 1.

As shown in a timing chart in FIG. 2, color data for four simultaneously driven rows of the LCD is output from two words of the display memory 16 in synchronization with a clock signal CLK and input directly to the corresponding scramblers 18. In the LCD driver 10 according to this embodiment, since color data for four simultaneously driven rows of the LCD are output from the display memory 16 at the same time, a line register, a potential selection register, and so on are not needed.

It should be noted that, in general, output signals from the display memory 16 change greatly during the time from the input of the word signal into the display memory 16 to the fixation of the output signals of color data corresponding thereto. Therefore, as shown in the timing chart in FIG. 2, the circuits following the scrambler 18 must be operated in synchronization with clock signal delayed in time at least until the output signals from the display memory 16 are fixed.

Further, since color data for four simultaneously driven rows of the LCD are output at the same time from the display memory 16, the frequency of the clock signal used in the LCD driver 10 according to the present invention may be one quarter of the frequency of the clock signal used in the conventional LCD driver shown in FIG. 5. Thus, in the LCD driver 10 according to the present invention, no register is required and one quarter of the operating frequency may be enough. Therefore, the power consumption can be reduced significantly.

Furthermore, as described in the description of the conventional technology, in the color data for one pixel, RGB data is combined and constructed as one unit. For example, in the case of 256 color (gray scale) display for one pixel, as shown in FIG. 6, 3 bits (7 to 5) at the MSB side are data for R, following 3 bits (4 to 2) are data for G, and 2 bits (1 and 0) at the LSB side are data for B. Thus, color data for one pixel is arranged such that the RGB data is arranged adjacent to one other.

On the other hand, in this embodiment, color data constructed by combining RGB data usually is decomposed into each color component, and data for four simultaneously driven rows of the LCD are stored in the display memory 16 such that bits of the same color component are arranged adjacent to for each column. Thus, a wasteful wiring area for wiring from the display memory 16 to the scramblers 18 on the layout can be omitted, which allows the chip-size to be reduced.

Notably, the present invention is not limited thereto, and color data in RGB units may be stored in the display memory 16. For example, in the case of the LCD driver 10 shown in FIG. 1, data is stored in the first word of the display memory 16 sequentially from the left in order of data R(4m+0,0), G(4m+0,0), B(4m+0,0), R(4m+0,1), . . . , R(4m+1,0), G(4m+1,0), B(4m+1,0), R(4m+1,1). . . . The same is true for the second word also.

This embodiment adopts the FRC method as a modulation method for gray scale display. Signals that are selected based on data R(0–3, 0) at the 0th column of R and gray scale conversion data of R are output from the corresponding scramblers 18. The signals output from the scramblers 18 are exclusive-ored (XOR) with corresponding row electrode selection patterns 0 to 3 by the EXOR gate 20 and are added by the adder 22.

The signal output from the adder 22 is input to the potential selector 24. Then, from among five potentials V0 to V4, one potential corresponding to the signal output from the adder 22 is selected and output in this embodiment. The 0th column of R of the LCD is driven at the potential output from the potential selector 24. Also, each column of the other colors of the LCD is driven in the same manner at the potential output from the corresponding potential selector 24.

The present invention is not limited to the above-described embodiment, and no limitation is imposed as long as if the number of simultaneously driven rows of the LCD is 2 or above.

Further, in the above-described embodiment, color data for two rows are stored in one word of the display memory. However, the present invention is not limited thereto, and color data for any number of rows of two or more may be stored in one word as long as it is not equal to or less than the number of rows to be driven simultaneously of the LCD. Furthermore, in the above-described embodiment, color data for two words is output simultaneously. However, color data for two or more words may be output simultaneously.

The LCD driver according to the present invention will be described below by using another embodiment shown in FIG. 3.

Figure 3:
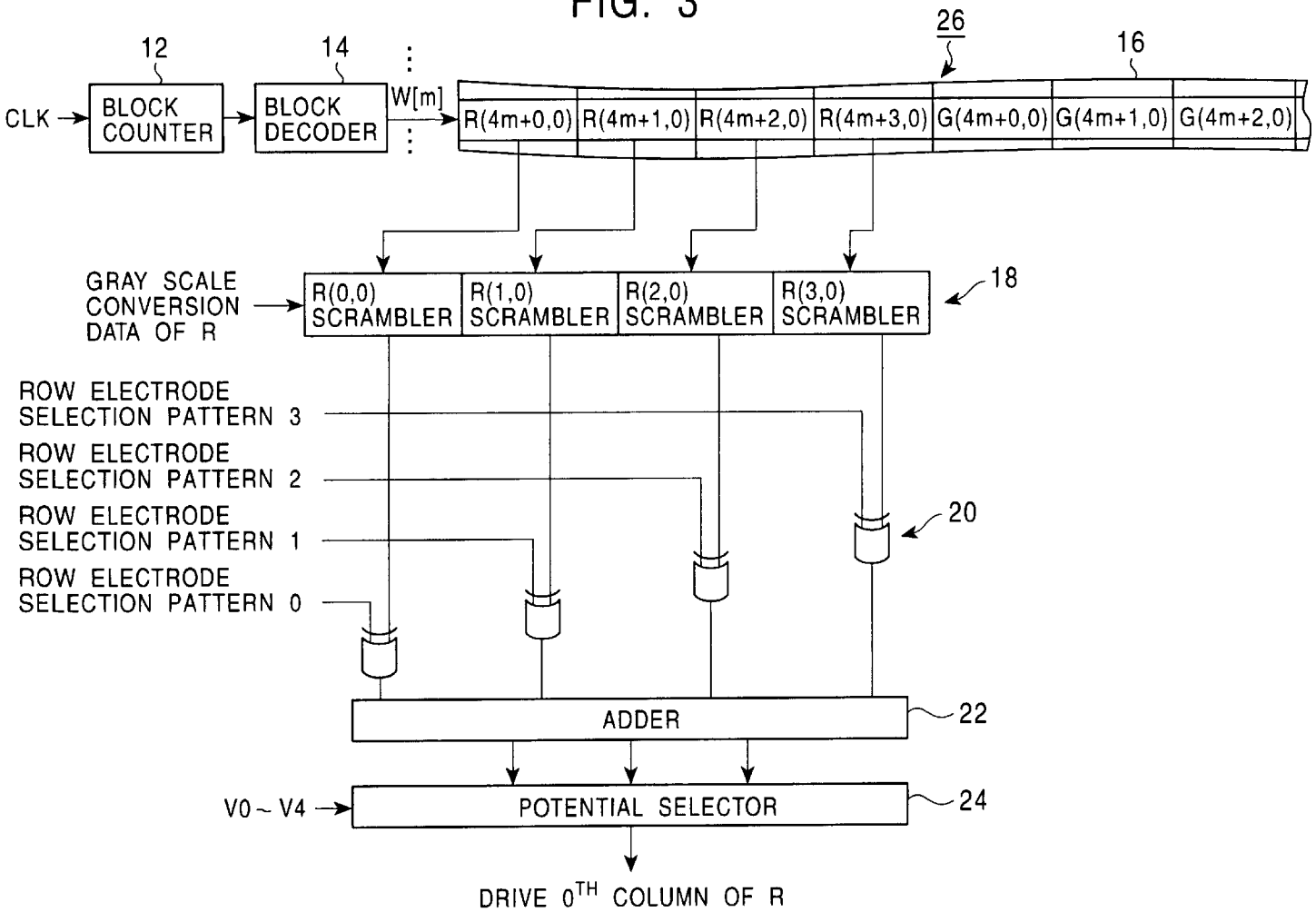
FIG. 3 is a schematic construction diagram of another embodiment of the LCD driver according to the present invention.

FIG. 3 is a schematic diagram of the structure of another embodiment of the LCD driver according to the present invention.

The LCD driver 26 shown in FIG. 3 has construction identical to that of the LCD driver 10 in FIG. 1 and adopts the MLS method for driving four rows of the LCD at the same time, like the LCD driver 10 shown in FIG. 1. However, the LCD driver 26 is different from the LCD driver 10 in that the LCD driver 26 in FIG. 3 stores color data for four simultaneously driven rows of the LCD in one word of the display memory 16.

Figure 4:
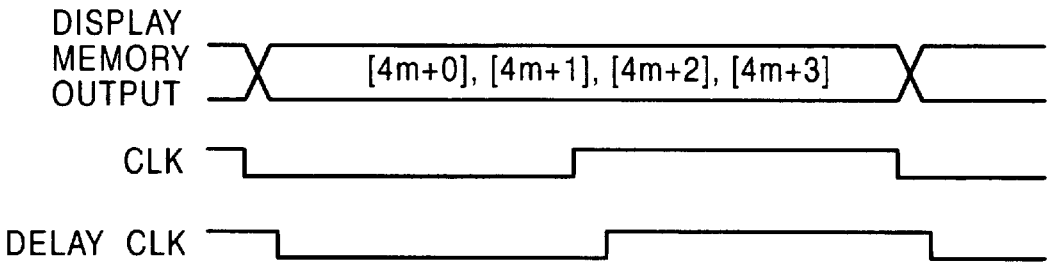
FIG. 4 is a timing chart representing the operation of the embodiment of the LCD driver shown in FIG. 3.

As shown in a timing chart in FIG. 4, in the LCD driver 26 in the example shown, color data for four rows of the LCD are output simultaneously from one word, which is selected by a word signal, of the display memory 16.

In each of the above-described embodiments, the example is used in which the FRC method is adopted as the modulation method for the gray scale display. However, the present invention is not limited thereto but is applicable in the same manner to LCD drivers adopting the pulse width modulation (PWM) method, the pulse height modulation (PHM) method, and a method combining them.

While the LCD driver according to the present invention has been described in detail, the present invention is not limited to the above-described embodiments. Various improvements and changes are possible without departing from the scope of the present invention.

As described above in detail, the LCD driver according to the present invention stores color data for two or more simultaneously driven rows of the LCD in one word of the display memory. Then a plurality of words of the display memory is selected and color data for simultaneously driven rows of the LCD are output. Further, the LCD driver according to the present invention, separates color data into each color component, and stores color data for simultaneously driven rows of the LCD in the display memory such that bits of the same color component are arranged adjacent to each other for each column. Thus, a plurality of words of the display memory are selected simultaneously, and color data for simultaneously driven rows of the LCD are output. Still further, the LCD driver according to the present invention stores color data for simultaneously driven rows of the LCD in a plurality of words of the display memory. The LCD driver selects the plurality of words of the display memory at the same time and outputs the color data. In addition, the present invention combines and performs two or more of above-mentioned techniques at the same time.

The LCD driver of the present invention, does not require the large number of registers that have been needed for the conventional LCD driver. Thus, the chip size can be reduced resulting in cost reduction. Additionally, since the operating frequency can be significantly reduced, the lifetime of battery-driven electronic equipment such as a mobile phone can be extended.

What is claimed is:

1. An LCD driver for simultaneously driving a plurality of rows of an LCD at a predetermined potential, comprising:

a display memory for storing color data, wherein the LCD driver stores the color data for two or more simultaneously driven rows of the LCD in one word in the display memory; and the LCD driver selects a potential corresponding to the color data stored in the display memory from several potentials in order to drive each column of the LCD.

2. An LCD driver according to claim 1, wherein the LCD driver separates the color data into each color component (RGB) and stores the color data for simultaneously driven rows of the LCD in the display memory such that bits having the same color component are adjacent to each other for each column of the LCD.

3. An LCD driver according to claim 1, wherein the LCD driver stores color data for simultaneously driven rows of the LCD in several words of the display memory and simultaneously selects the several words of the display memory for the simultaneously driven rows of the LCD and outputs the color data.

4. An LCD driver according to claim 2, wherein the LCD driver stores color data for simultaneously driven rows of the LCD in several words of the display memory and simultaneously selects the several words of the display memory for the simultaneously driven rows of the LCD and outputs the color data.

5. An LCD driver according to claim 1, wherein the number of the several potentials is equal to the number of simultaneously driven rows of the LCD plus one.

6. An LCD driver for simultaneously driving a plurality of rows of an LCD at a predetermined potential, comprising:

a display memory for storing color data, wherein the LCD driver stores color data for simultaneously driven rows of the LCD in several words of the display memory and simultaneously selects the several words of the display memory for the simultaneously driven rows of the LCD and outputs the color data, each word representing color data for at least two rows; and the LCD driver selects a potential corresponding to the color data stored in the display memory from several potentials in order to drive each column of the LCD.

7. An LCD driver according to claim 6, wherein the LCD driver separates the color data into individual color components and stores the color data for simultaneously driven rows of the LCD in the display memory such that bits having the same color component are adjacent to each other for each column of the LCD.

8. An LCD driver according to claim 6, wherein the number of the several potentials is equal to the number of simultaneously driven rows of the LCD plus one.

9. A method for simultaneously driving a plurality of rows of an LCD at a predetermined potential comprising:

storing color data for two or more simultaneously driven rows of the LCD in a single word in a display memory; and selecting from several potentials a potential corresponding to the color data stored in the display memory in order to drive each column of the LCD.

10. The method according to claim 9, further comprising:

separating the color data into each color component (RGB):

storing the color data for the simultaneously driven rows of the LCD: and arranging the color data in the display memory such that bits having the same color component are adjacent to each other for each column of the LCD.

11. The method according to claim 10, further comprising:

storing the color data for the simultaneously driven rows of the LCD in several words of the display memory, while simultaneously selecting several words of the display memory for the simultaneously driven rows of the LCD.

12. The method according to claim 9, further comprising:

storing the color data for the simultaneously driven rows of the LCD in several words of the display memory, while simultaneously selecting several words of the display memory for the simultaneously driven rows of the LCD.

* * * * *